United States Patent [19]

Fink et al.

[11] 4,367,807

[45] Jan. 11, 1983

[54] SOUND ABSORBER FOR COMPRESSED-AIR OPERATED APPARATUSES, IN PARTICULAR COMPRESSED AIR VIBRATORS

[75] Inventors: Willy Fink, Giersbergstrasse CH-8479 Waltalingen, Switzerland; Alex Fehr, Henggart, Switzerland

[73] Assignee: Willy Fink, Waltalingen, Switzerland

[21] Appl. No.: 268,487

[22] Filed: May 29, 1981

[30] Foreign Application Priority Data

May 30, 1980 [CH] Switzerland ..... 4245/80

[51] Int. Cl.[3] ..... F01N 1/08

[52] U.S. Cl. ..... 181/230; 181/243; 181/267; 181/272; 181/281; 181/282

[58] Field of Search ..... 181/230, 237, 239, 254, 181/264, 267, 272, 274, 275, 279, 282; 55/276; 173/DIG. 2; 415/119; 137/484.6, 484.8, 848

[56] References Cited

U.S. PATENT DOCUMENTS 2,046,017 6/1936 Coanda ..... 181/264 X

*Primary Examiner*—Benjamin R. Fuller

*Attorney, Agent, or Firm*—Scully, Scott, Murphy & Presser

[57] ABSTRACT

The sound absorber includes a main body (1), a housing component (2) attached thereon and a cap (3) threaded onto the main body. The compressed air exiting from the compressed-air vibrator flows from a first chamber (4) into a second chamber (5) provided with labyrinth-like baffles (7) and from there into a larger third chamber (6). The relieved compressed air then flows outside through an annular outlet slit (8*a*). Through rotation of the cap (3) there can be varied the cross-section of the outlet slit (8*a*). The cap (3) thereby also serves as a throttle valve.

The sound absorber is insensitive to oil-containing compressed air and, without an auxiliary throttle valve, facilitates a correlatable throttle of the exiting compressed air.

3 Claims, 4 Drawing Figures

SOUND ABSORBER FOR COMPRESSED-AIR OPERATED APPARATUSES, IN PARTICULAR COMPRESSED AIR VIBRATORS

The invention relates to a sound absorber in accordance with the preamble of claim 1.

It is already known for sound absorbers utilized for the reduction of the operating noise levels of pneumatic sledge hammers to arrange a plurality of relief chambers sequentially in the flow direction (German Laid-open Patent Application No. 2 360 430). Since such sledge hammers evidence relatively large dimensions, the arrangement of the chambers on the apparatus causes no difficulty.

In contrast therewith, compressed-air vibrators evidence mostly small dimensions. Accordingly, it is usual to generally equip such apparatuses with small sound absorbers in which the compressed air exits through porous inserts which, for example, are formed of felt, or through porous chamber walls, for example, of sintered metal or plastic material. These porous sound absorbers have the disadvantage that for oily or dirty compressed air the pores of the porous elements will clog so as to restrict the through-passage of air, which leads to uncontrolable changes in the frequency of the apparatuses. As a result, such sound absorbers must be frequently cleaned or exchanged already after short operating periods.

In particular for piston vibrators, which are mounted on transport troughs for pourable goods, the maintenance of a predetermined frequency is extremely important. The suitable frequency is hereby controlled through an additional throttle valve arranged on the air outlet side. Frequency changes through clogged sound absorbers can bring the flow of the conveyed goods in the trough to a standstill. Porous sound absorbers are thereby unsuitable for this purpose.

Accordingly, it is an object of the present invention to provide a sound absorber which can be economically produced with small dimensions, which is subjected to practically no contamination and which also facilitates an adjustable throttling of the exiting air, so that for predetermined purposes of application the addition of a further throttle valve becomes superfluous.

The foregoing object is achieved through the construction pursuant to the characterizing portion of claim 1.

During the passage of the pulsating compressed air through the three relief chambers, between which there are arranged through-bores acting as throttles, the noise level of exiting air will be extensively attenuated. Since no porous elements are present, there also cannot occur any clogging of the sound absorber through oil-containing compressed air.

The construction of the sound absorber pursuant to claim 2 provides the advantage that the cap which is threaded thereon renders an additional throttle valve to be superfluous.

The invention is now elucidated in detail on the basis of an exemplary embodiment as illustrated in the drawing. Shown herein:

Figure 1:
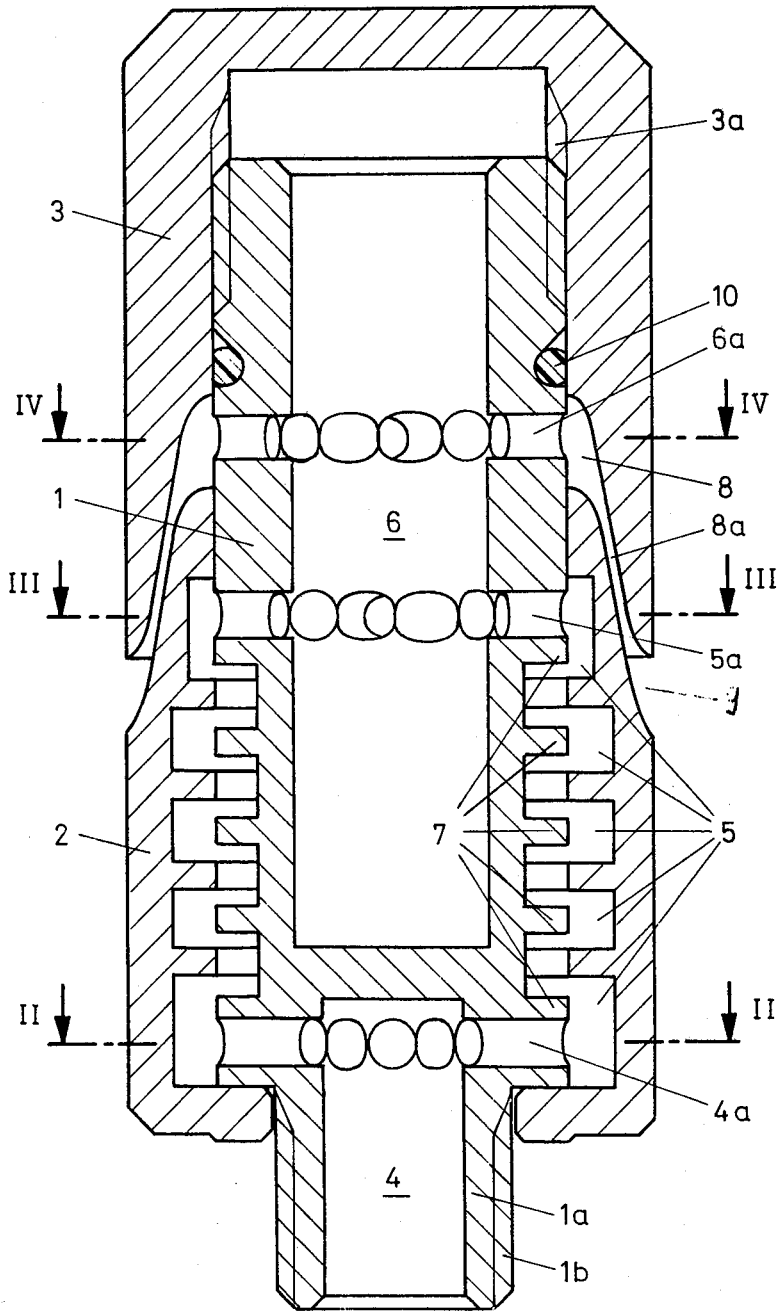
FIG. 1 is an axial section through a sound absorber with a throttle valve.
Figure 2:
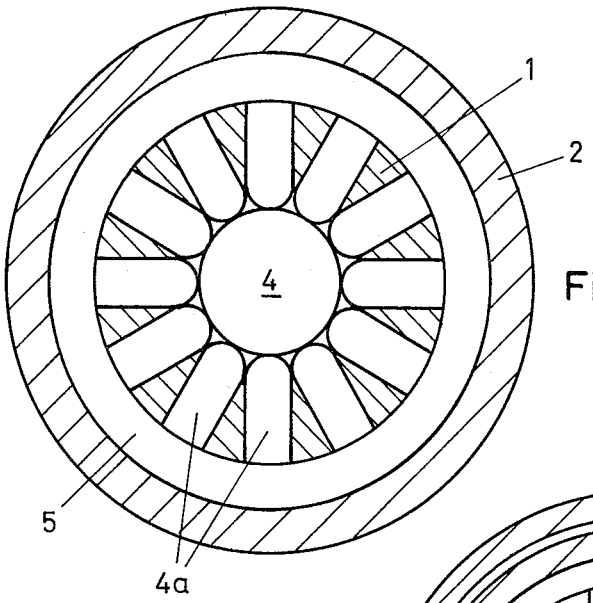
FIGS. 2–4 illustrate cross-sections taken along, respectively, lines 2—2, 3—3 and 4—4 in FIG. 1.
Figure 3:
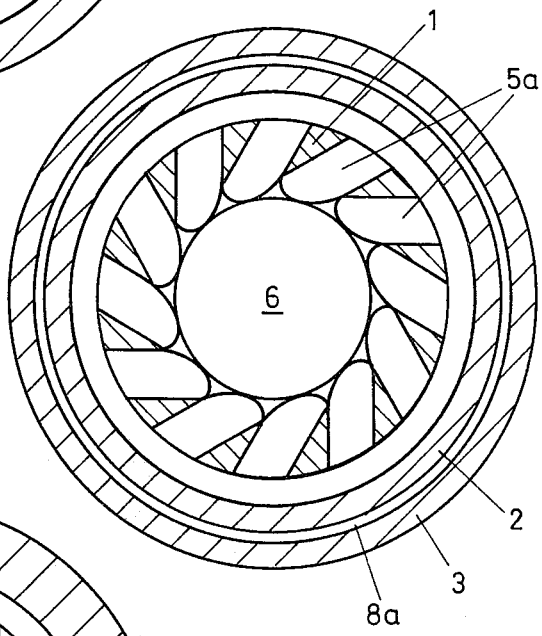
Figure 4:
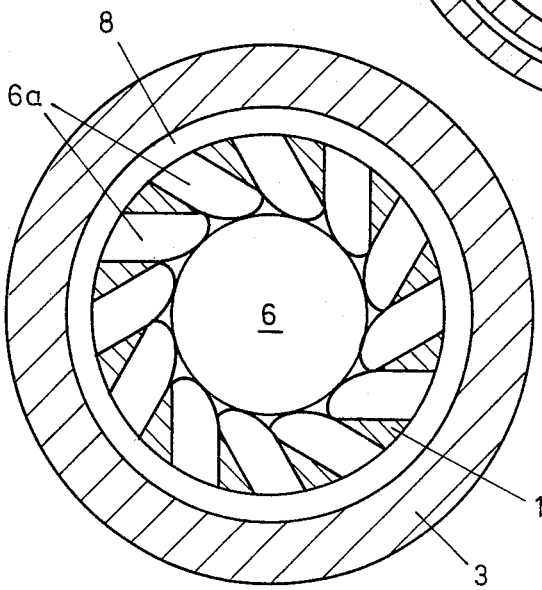

The sound absorber pursuant to FIG. 1 includes three main components, a central main body 1, a housing 2 mounted thereon, and a cap 3 which is threaded onto the upper portion of the main body 1. The main body 1 includes in the lower portion an inlet connector 1*a* with a threading 1*b*, by means of which it can be threaded directly into an outlet opening of a compressed-air vibrator. The connector 1*a* contains a first chamber 4, from which the compressed air flows through radial through-bores 4*a* into a second chamber 5, which is bounded by the walls of the main body 1 and thereon mounted housing 2. The chamber 5 is annularly-shaped and elongate and contains labyrinth type baffles 7 which are formed by outwardly or, respectively, inwardly projecting projections on the components 1 or 2. On the upper end of the chamber 5 there are arranged approximately tangential through-bores 5*a* in the main body 1, through which the compressed air is conducted into a central vortex chamber 6 which is substantially larger than the chambers 4 and 5. Within this vortex chamber 6 there will further relieve the compressed air. The air then flows after more intense swirling through the through-bores 6*a*, which are arranged oppositely tangential relative to the bores 5*a*, into an annular chamber 8 and then escapes to the outside through an annular-shaped outlet slit 8*a*. The widening end 9 of the outlet slit 8*a* considerably reduces the hissing noise of the exiting air.

The cap 3 is provided with an internal thread 3*a* and is screwed onto a corresponding external thread on the main body 1. Through rotation of cap 3 there can be varied the cross-section of the outlet slit 8*a*. The cap 3 thus serves also as a throttle valve for the exiting compressed air. The throttling of the exiting air within the adjustable slit 8*a* facilitates an additional strong reduction in the sound level; however, it results in a power reduction of the compressed-air vibrator which, nevertheless, can be accepted in general when the sound level of the apparatus must be reduced to an acceptable minimum. A rubber ring 10 acting as a friction ring prevents an unintentional rotation of the cap 3.

The three components 1, 2, and 3 of the sound absorber can be produced from metal or plastic material. The sound absorber is easily disassembled and thus can be readily cleaned.

What is claimed is:

1. A sound absorber for compressed air-operated apparatuses, comprising a body having an inlet connector, connectable to an outlet aperture of the air-operated apparatus, and further comprising a plurality of sequentially arranged relief chambers for the compressed air, said inlet connector being coupled to a first chamber (4) having first through-bores (4*a*) extending therefrom to a second chamber (5), which includes an elongate, annular hollow chamber having an outer wall and contains therein labyrinth-like baffles (7), said second chamber (5) further being connected by second through-bores (5*a*) to a third chamber (6) which includes third through-bores (6*a*) extending to an annular outlet slit (8*a*), and said outlet slit having an adjustable cross-section.

2. A sound absorber as claimed in claim 1, said annular outlet slit (8*a*) comprising an opening formed between said outer wall of the second chamber (5) and a cap (3) threaded onto said body and having internal threads (3*a*) therein, such that the slit is adjustable by rotation of the cap (3).

3. A sound absorber as claimed in claim 1, said first through-bores (4*a*) being radially directed between the first chamber (4) and the second chamber (5), said second through-bores (5*a*) being oppositely directed between the second chamber (5) and the third chamber (6), and said third through-bores (6*a*) being arranged between the third chamber (6) and the outlet slit (8*a*).

* * * * *